US009250049B1

(12) United States Patent
DeMeester

(10) Patent No.: US 9,250,049 B1
(45) Date of Patent: Feb. 2, 2016

(54) SABOTS FOR PROJECTILES

(71) Applicant: The Boeing Company, Chicago, IL (US)

(72) Inventor: Craig R. DeMeester, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/068,735

(22) Filed: Oct. 31, 2013

Related U.S. Application Data

(60) Provisional application No. 61/846,482, filed on Jul. 15, 2013.

(51) Int. Cl.
*F42B 14/06* (2006.01)

(52) U.S. Cl.
CPC ..... *F42B 14/06* (2013.01); *F42B 14/061* (2013.01); *F42B 14/062* (2013.01); *F42B 14/067* (2013.01); *F42B 14/064* (2013.01); *F42B 14/068* (2013.01)

(58) Field of Classification Search
CPC ..... F42B 14/06; F42B 14/061; F42B 14/062; F42B 14/064; F42B 14/065; F42B 14/067; F42B 14/068; F42B 14/08
USPC ..... 102/520, 521, 522, 523
See application file for complete search history.

(56) References Cited

U.S. PATENT DOCUMENTS

| | | | | |
|---|---|---|---|---|
| 2,983,225 A * | 5/1961 | Walker | F42B 14/064 102/523 |
| 4,043,269 A * | 8/1977 | Ambrosini | F42B 14/064 102/513 |
| 5,902,955 A * | 5/1999 | Rossmann | 102/521 |
| 6,324,986 B1 * | 12/2001 | Rossmann et al. | 102/521 |
| 6,805,058 B2 * | 10/2004 | Eches et al. | 102/521 |

* cited by examiner

*Primary Examiner* — James S Bergin
(74) *Attorney, Agent, or Firm* — Joseph M. Butscher; The Small Patent Law Group LLC

(57) ABSTRACT

Sabots for projectiles are provided. One sabot includes a body formed from at least one section, wherein the body is configured to surround a portion of a projectile. The sabot also includes one or more engagement portions configured to interface the body with another sabot such that the body is supported at an intermediate position of the projectile, and one or more surfaces configured to interface with an outer mold line of the projectile. The sabot further includes one or more surfaces configured to interface with an inner surface of a launch platform.

20 Claims, 5 Drawing Sheets

SABOTS FOR PROJECTILES

CROSS-REFERENCE TO RELATED APPLICATIONS

This application claims priority to and the benefit of the filing date of U.S. Provisional Application No. 61/846,482, filed on Jul. 15, 2013, entitled "Sabots for Projectiles," which is hereby incorporated by reference in its entirety.

BACKGROUND

The present disclosure relates generally to sabots for projectiles, such as sabots for hypervelocity projectiles.

Sabots are devices that may be used when firing a projectile, such as when the projectile is smaller than the diameter of the bore from which the projectile is shot or launched, to maintain a position of the projectile within the bore. Some conventional sabot designs use high performance materials (e.g. titanium metal matrix composite). However, these designs interface with the projectile in a manner that is not efficient for these materials. Therefore, these designs have additional mass to handle the inefficiencies of the load path.

Additionally, because existing sabots are completed using composite or metallic designs, due to the length of a projectile, the existing designs of sabots fill the gun bore from the pusher plate (or armature) to near the nose of the projectile. As a result, materials must be used that can withstand the mass thereof, which include, for example, high grade metals or composite materials. These materials are rigid in nature and provide no cushion for the projectile during the launch event. Thus, conventional sabots are designed with thin inserts to provide low wear surface for the gun bore. The cost to produce these sabots is high due to the composite process or the cost of machining complex designs. Also, due to the length of the sabots and general volume the sabots are filling, the weight of the sabot can increase very quickly based on the caliber of the gun bore.

SUMMARY

In accordance with an embodiment, a sabot is provided that includes a body formed from at least one section, wherein the body is configured to surround a portion of a projectile. The sabot also includes one or more engagement portions configured to interface the body with another sabot such that the body is supported at an intermediate position of the projectile, and one or more surfaces configured to interface with an outer mold line of the projectile. The sabot further includes one or more surfaces configured to interface with an inner surface of a launch platform.

In accordance with another embodiment, a sabot is provided that includes a body having an interface for engaging an axial sabot and at least two complementary components defining an interface for an outer mold line of a projectile and an interface for a barrel of a launch platform. The body is constructed from a moldable material and is configured to reduce balloting of the projectile during launch.

In accordance with another embodiment, a projectile is provided that includes a cylindrical body having a plurality of grooves on an outer surface thereof, wherein the plurality of grooves is configured to engage an axial sabot. The projectile also includes a secondary sabot having a body formed from at least one section, the body configured to surround a portion of the cylindrical body. The secondary sabot also includes one or more engagement portions configured to interface the body with the axial sabot such that the body is supported at an intermediate position of the cylindrical body, one or more surfaces configured to interface with an outer mold line of the cylindrical body, and one or more surfaces configured to interface with an inner surface of a launch platform.

DETAILED DESCRIPTION

Figure 1:
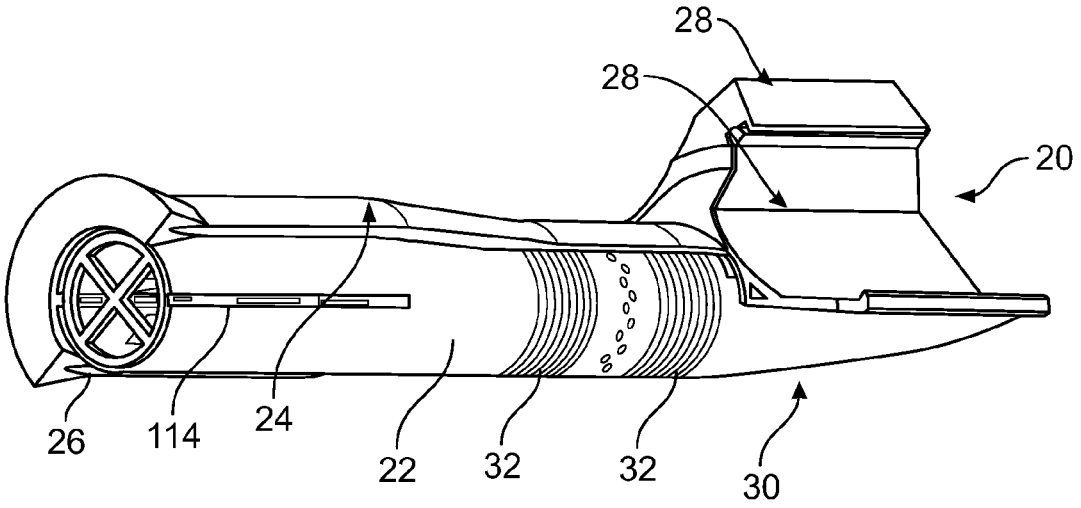
FIG. 1 is a cut-away illustration of a sabot in accordance with an embodiment engaged with a projectile.

The following detailed description of certain embodiments will be better understood when read in conjunction with the appended drawings. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide one or more sabots, such as for use with projectiles, including hypervelocity projectiles. Some embodiments provide a multi-piece sabot that centers the projectile in the bore (which may be referred to as a multiple piece sabot or lateral sabot) that interfaces with another second sabot that imparts the launch loading on the projectile (which may be referred to as an axial sabot). By practicing at least one embodiment, balloting loads within guided projectiles is reduced, thereby increasing the survivability of sensitive guidance sensors. By practicing at least one embodiment, a compliant interface to a launch platform (e.g., a gun bore) may be provided that reduces bore wear while tolerating more gun bore tolerances. By practicing at least one embodiment, a sabot with less weight may be provided allowing for more payload or less cost per shot. By practicing at least one embodiment, a lower cost sabot may be provided that includes a moldable design instead of a machined design.

In particular, various embodiments provide a sabot 20, a portion of which is shown in FIG. 1. As used herein, the term "sabot" in various embodiments refers to any structure or device that is used with a projectile aligned within a launch platform (e.g., a canon), such as to fill the space between the outer circumference of a projectile 22 and the inner circumference of the launch platform, and/or to impart launch loading onto the projectile 22. For example, different sabots 20 may be provided for use with different caliber projectiles 22 to be launched from within the same cannon, such as to accommodate for different outer dimensions (e.g., outer circumference) of the projectile 22. The sabot 20 in various embodiments surrounds a portion of the projectile 22 along an axial direction (A) of the length of the projectile 22 that may be forward of another sabot 24. For example, in some embodiments, the sabot 24 may be a stepped sabot as described in co-pending application Ser. No. 14/061,347, entitled "Stepped Sabots for Projectiles", the entire disclosure of which is incorporated by reference. However, it should be appreciated that the sabot 20 may engage other types of sabots 24 along the projectile 22 or engage the projectile directly.

In general, the sabot 24 extends from a base 26 forward along the projectile 22 and engages with the sabot 20. In the illustrated embodiment, the sabot 24 extends along a greater axial length of the projectile 22 than the sabot 20 to support the sabot 20 in an intermediate position (such that the sabot 20 in some embodiments is a secondary sabot to the sabot 24), for example, between the front and aft of the projectile 22, which may be at different locations along the projectile axial length.

It should be noted that in various embodiments, the sabot 20 (as well as the sabot 24) is configured to receive therein the projectile 22 for placement and subsequent deployment from a cannon or other launch platform or firing mechanism. The sabot 20 may include various features as described in more detail herein that facilitate engagement with other components (such as the sabot 24). Thus, in some embodiments, different sabots or sabot parts may be provided with the sabot 20 configured to support the balloting of the projectile 22 during launch and the sabot 24 is configured to transmit the launch acceleration into the projectile body. It should be noted that any of the sabots (e.g., the sabot 20 or 24) are discarded (e.g., separated from the projectile 22) upon exit from the launch platform bore (not shown).

The sabot 20 in various embodiments has a multi-piece design or construction such that multiple sections 28 (two sections 28 are shown in FIG. 1) engage around the circumference of the projectile 22, as well as to the sabot 24. It should be noted that the number of sections 28 may be varied as desired or needed. Additionally, in some embodiments, the sabot 20 is a single pieces design, such as formed from a single unitary body.

In various embodiments, the sabot 20 may be placed along the projectile 22 only where needed (e.g., to reduce balloting), thereby reducing the length of the sabot 20. For example, as seen in FIG. 1, the sabot 20 is positioned along only a front end 30 of the projectile 22 to support the balloting of the projectile 22 where needed. Thus, in various embodiments, the sabot 24 may be used to support a restricted or shorter length of the sabot 20.

In operation, at higher launch speeds, for example hypervelocity speeds, using only a full length conventional sabot would result in the sabot collapsing due to the mass of the sabot, and accordingly, the sabot is made from high-grade aluminum or other high performance materials. The sabot 20, which may be used in combination with the sabot 24, allows for the sabot 20 to be made from different materials, including plastic. In some embodiments, the use of compliant plastic reduces the balloting (movement in the two axes orthogonal to the launch axis) during launch, which can increase launch accuracy. In other embodiments, the sabot body formed from the sections 28 may be constructed from moldable materials. For example, in one embodiment, the sections 28 are formed from moldable polyamide materials, such as glass-reinforced moldable polyamide materials or other moldable materials.

Thus, the reduced length of the sabot 20 in various embodiments enables the use of alternative materials that are compliant in nature. These materials can be designed similar to shock absorbers or springs to reduce the balloting load on the projectile 22 and the shocks that the sabot experiences during launch. In various embodiments, the sabot 20 is designed to reduce the environmental requirements during launch of the guidance sensors. Also, because compliant materials are used in some embodiments, the sabot 20 is also designed to be compressed radially when installed in the gun bore, which allows the sabot 20 to be used in gun bores that have larger variation in size due to wear or manufacturing tolerances.

Accordingly, different materials may be used for constructing the sabot 20 or sabot 24. For example, in some embodiments the sabot 24 may be constructed from a high specific strength material such as a metal matrix composite, polymer matrix composite, or structural ceramic and the sabot 20 formed from moldable polyamide materials.

Figure 2:
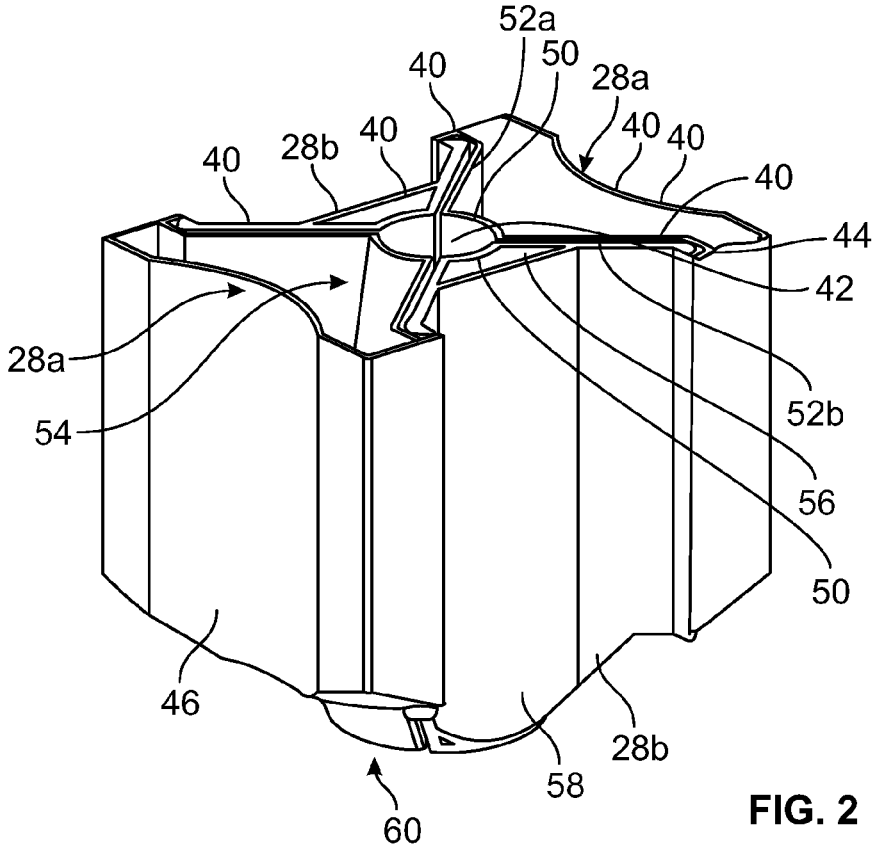
FIG. 2 is an illustration of the sabot of FIG. 1

The sabot 20 generally includes surfaces as described herein to engage with the sabot 24. In various embodiments, the sabot 20 is configured in a web-type design as shown in FIG. 2. The sabot 20 includes interface surfaces 40 for engaging or abutting complementary surfaces of the sabot 24 as described in more detail herein. In the illustrated embodiment, the sections 28*a* include a curved or concave outer profile to define a contact area for contacting with conducting rails (not shown) of a railgun. It should be noted that the shape and configuration of the outer surface profile of the sections 28*a* may be varied as desired or needed. For example, the sections 28*a* may have an outer surface profile with more or less curvature along more or less of the outer surface thereof.

In the illustrated embodiment, the sections 28*a* engage with the sections 28*b*. For example, the shapes and/or configurations of the sections 28 are provided to allow the sections 28 to form the sabot 20 and define a bore 42 therethrough for receiving a portion of the projectile 22 (e.g., the front end 30 of the projectile 22 as shown in FIG. 1). A portion of the projectile 22 may extend beyond the forward end of the sabot 20. Additionally, the size of the bore 42 may change, for example, change diameter, to accommodate the changing outer diameter of the projectile 22 (e.g., varying diameter). Additionally, an engagement end 60 of the sabot 20 is sized and shaped (e.g., curved) to engage complementary portions of the sabot 24 as described in more detail herein.

In the illustrated embodiment, the sections 28*a* are in opposing engagement with respect to each other and the sections 28*b* are also in opposing engagement with respect to each other. For example, in the four piece design shown in FIG. 2, each of the sections 28 generally encompass 90 degrees around the outer circumference of the projectile 22. Also, the sections 28*a* are sized and shaped similarly to each other and the sections 28*b* are sized and shaped similarly to each other. The sections 28*a* and 28*b* have a similarly curved inner surface 50 that engages and contacts the outer surface of the projectile 22. The sections 28*a* and 28*b* also have angled supports 52*a* and 52*b* that extend radially outward to engagement portions that allow for the sections 28*a* and 28*b* to engage together. For example, in the illustrated embodiment, the sections 28*a* have shoulders 44 that engage shoulders 46 of the sections 28*b* to maintain the sections 28*b* compressed between the sections 28*a*. The shoulders 44 generally define a planar surface for engaging a complementary surface of the shoulders 46. For example, when inserted within a gun bore, the sections 28*a* compress the sections 28*b* therebetween and engage around the projectile 22 (e.g., the sections 28 compressingly engage one another).

The sections 28 generally define webs having a spacing therein between the walls of the sections 28 (e.g., define a web-shaped body). For example, the sections 28*a* include openings 54 therethrough and the sections 28*b* have openings 56 therethrough. In the illustrated embodiment, the openings 54 are larger than the openings 56 such that the webs firmed from the sections 28*a* are larger than the webs formed from the sections 28*b*. However, the size of the openings 54 and 56 may be varied. For example, an outer wall 58 of the sections 28*b* may be moved radially outward to increase the size of the openings 56 or other webs may be added to change the number and size of the openings 56.

It should be noted that the shape of the sections 28 and the configuration of the sections 28, including the thickness of the walls, may be varied as desired or needed. For example, the shape or configuration of one or more of the sections 28 may be varied in design to isolate a particular frequency of interest (e.g., sound wave frequency from a launch platform).

Figure 3:
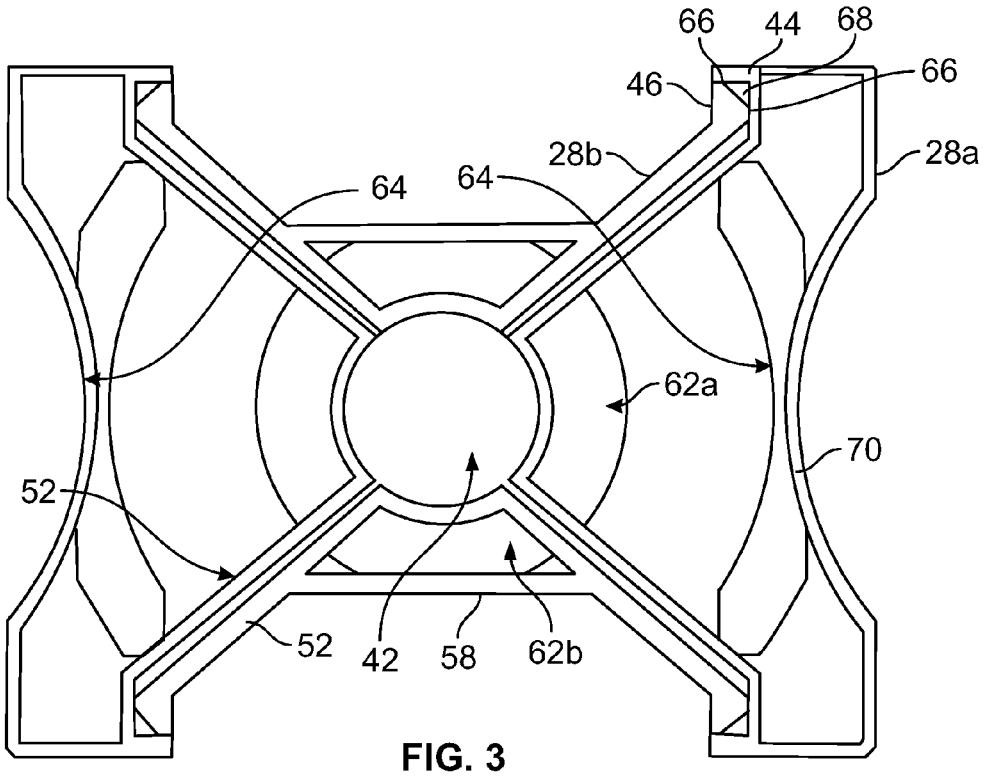
FIG. 3 is another illustration of the sabot of FIG. 1.

FIG. 3 is a view of the sabot 20 looking aft. As can be seen, the bore 42 defines and opening through the sabot 20 for receiving the projectile 22. Additionally, the portions 62*a* and 62*b* are shaped (e.g., molded) to match the outer circumference and shape of the projectile 22 (e.g., match the projectile OML). For example, the portions 62*a* and 62*b* define regions or complementary components, such as one or more surfaces, that mate with the outer moldline of the projectile 22 (which in this embodiment is in four places).

Additionally, the curved regions 64 of the sections 28*a* that may include one or more surface are configured to contact the rails of the gun to compress the sections 28 together when inserted within the gun bore as described herein. It should be noted that the thickness of the supports 52 for the sections 28*a* and 28*b* may be the same or different (illustrated as different). Additionally, the thicknesses of the supports 52 (which may be referred to herein as web thicknesses) and the locations of and/or number of supports 52 may be configured, for example, based on an expected balloting load profile to tune out balloting content.

With respect to the shoulders 44 and 46, in the illustrated embodiment, two contact regions 66 (or engagement regions) are provided. However, more or less contact regions 66 may be provide. In this embodiment, the shoulder 44 generally defines a cavity region 68 in which the shoulder 46 is received. The shoulder 44 has a generally triangular profile with planar ends for engaging the shoulder 44 at the contact regions 66. Thus, an engagement fit is defined by the shoulders 44 and 46. However, other configurations and engagements may be provided. In general, the shoulders 44 and 46, or other engagement portions ensure that the sabot 20 has structural load paths and is engaged with the projectile 22 when inserted within, for example, the gun bore.

It should be noted that the outer wall 58 of the sections 28*b* is positioned radially inward of the outer walls 70 of the sections 28*a* so as to not contact the inner surface of the gun bore. Additionally, in operation, when leaving the gun bore, such as when the projectile 22 is launched, the sections 28*a* release the sections 28*b* to allow separation therefrom. At hypervelocity speeds, the sections 28 may disintegrate due to the internal pressure versus atmospheric pressure.

Figure 4:
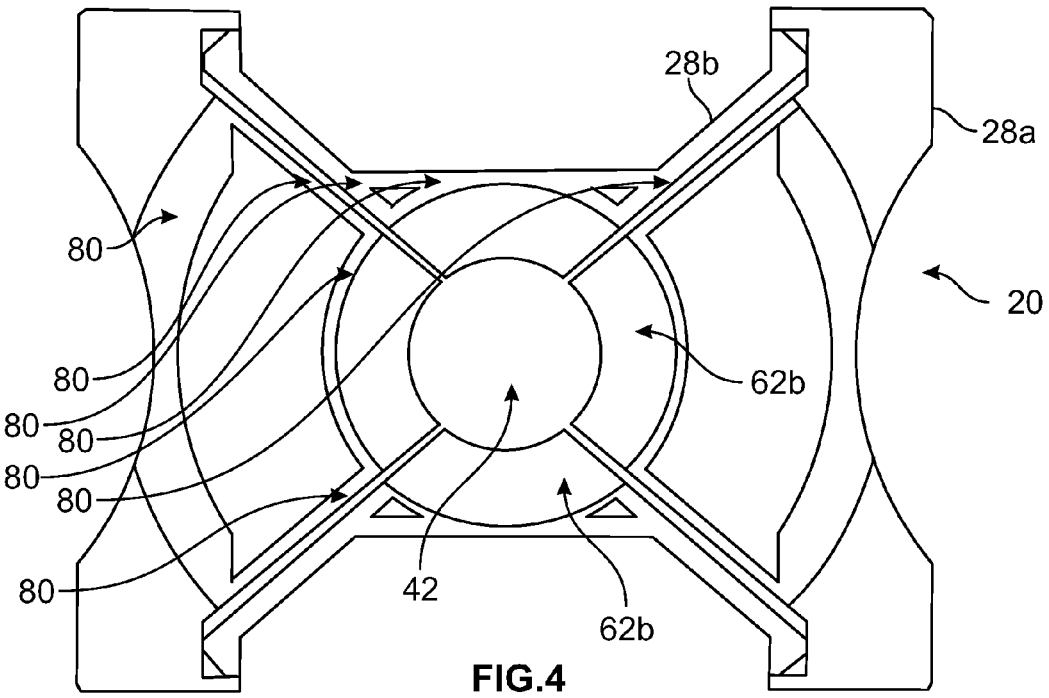
FIG. 4 is another illustration of the sabot of FIG. 1.

As can be seen in FIG. 4, which is a view of the sabot 20 looking forward, a plurality of interface surfaces 80 are provided for engaging with the sabot 24. It should be noted that in some embodiments, where the sabot 24 is not provided, a high performance material (e.g., metal) may be added to the interface surfaces 80 to engage directly with the projectile 22 (e.g., engage the projectile body). As can also be seen, the portions 62 are concave to receive a portion of the projectile 22 therein (e.g., concave inner wall portions to mate with an outer surface of the projectile 22).

Figure 5:
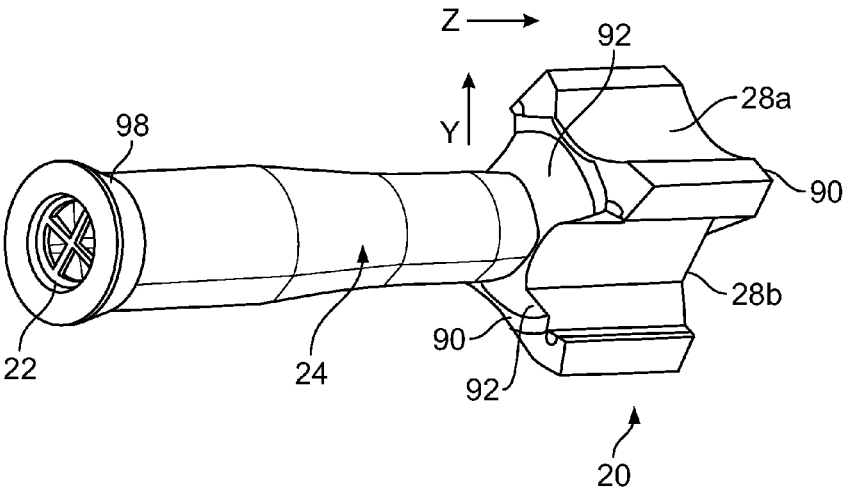
FIG. 5 is an illustration of a sabot in accordance with an embodiment engaged with a separate sabot on a projectile.
Figure 6:
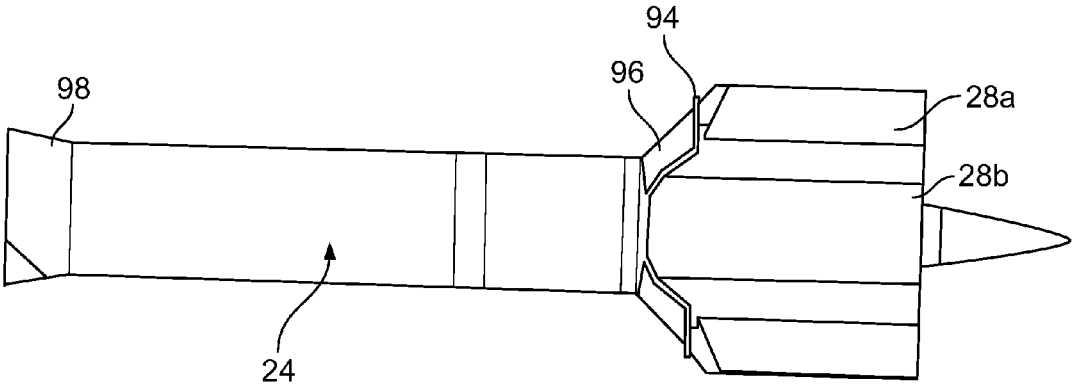
FIG. 6 is another illustration of a sabot in accordance with an embodiment engaged with a separate sabot on a projectile.

Thus, for example, as shown in FIG. 5, the sabot 20 engages with the sabot 24 along the projectile 22. In various embodiments, the sabot 22 provides a more compliant ride or travel through the launch platform bore in the X axis and Y axis. The sabot 24 includes engagement portions 90 and 92, illustrated as a lip and curved portion, respectively, that engage complementary portions of the sabot 20. For example, the engagement portions 90 and 92 of the sabot 24 engage the interface surfaces 80 of the sabot 20, such as in abutting engagement. A similar engagement is shown in FIG. 6, but wherein the sabot 24 is designed as described in co-pending application Ser. No. 14/061,347 and having engagement portions 94 and 96.

It should be noted that the sabot 24 generally includes a cylindrical body (e.g., a cylindrical tubular body) that extends along the axial length of the projectile 22. In the illustrated embodiment, the body includes a flared end 98 at the base of the sabot 24 (e.g., flared or curved outward), which is shown positioned at the base of the projectile 22. The flared end 98 in some embodiments is configured to engage the propulsion mechanism of the launch platform, for example, the pusher plate of a gun and may also be used for introducing aerodynamic drag for aft separation from the projectile 22. It should be noted that the configuration and amount of flaring of the flared end 98 may be varied. Also, in some embodiments, a flared end 98 is not provided. The flared end 98 in various embodiments also distributes the load as the pusher plate of the launch platform may be formed form a lower strength material.

Additionally, in the illustrated embodiments, a flared front end or scoop on the front end of the sabot 24 may be optionally or additionally provided. In this embodiment, the aerodynamic drag on the flared or scooped front end pushes the sabot 24 off of the aft end of the projectile 22 after exiting the gun.

It also should be noted that the projectile 22 with the sabot 20 (an optionally the sabot 24) may be launched or fired from different types of guns. For example, a railgun type of system may be used to fire the projectile 22 and sabot 20, such as described in U.S. Pat. No. 7,526,988, which is incorporated by reference herein in its entirety. For example, the railgun system described in FIGS. 1 and 2 of U.S. Pat. No. 7,526,988 may be used.

Figure 7:
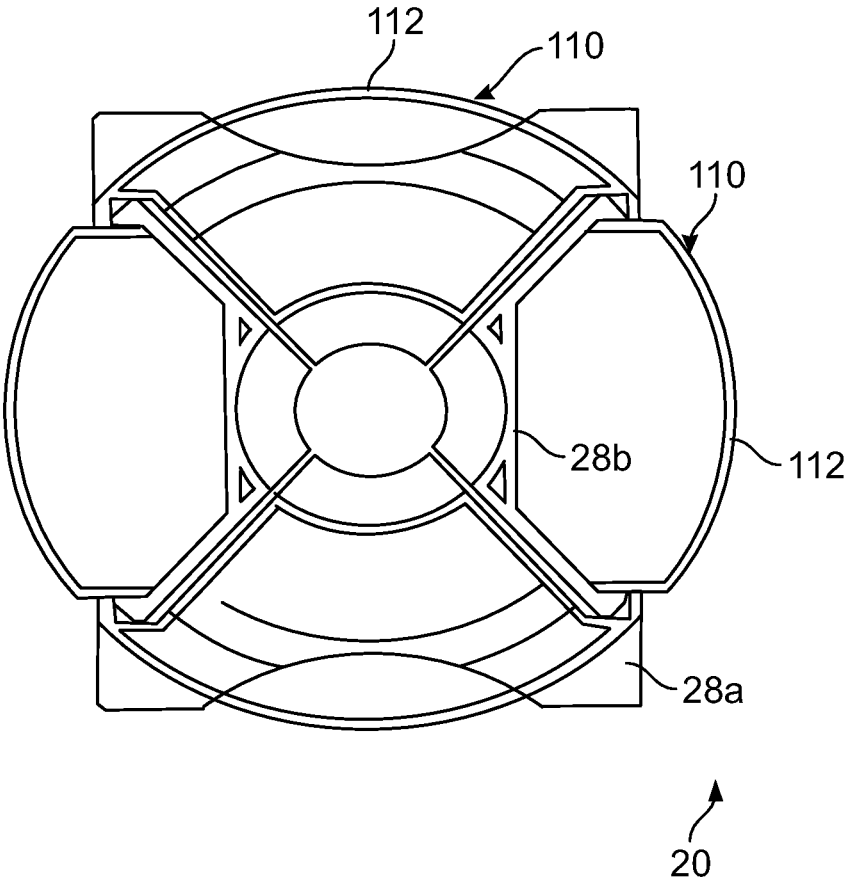
FIG. 7 is an illustration of a sabot in accordance with another embodiment.

However, various embodiments provide sabots for use with non-railguns, such as with conventional guns. In this embodiment as shown in FIG. 7, the sabot 20 includes engagement members 110 that form part of the sections 28*a* and 28*b* and extend radially outward to define convex regions 112 that include one or more surfaces (e.g., convex outer wall portions) to contact the inner surface of the bore of the launch platform. The engagement members 110 may be integrally formed with the sections 28*a* and 28*b*, may be separate from the sections 28*a* and 28*b* and optionally coupled thereto (e.g., using a fastening mechanism or compression held).

Thus, in various embodiments, the sabot 20 is supported at an intermediate position along the projectile 22. The sabot 20 may be supported in this position by the projectile 22 and/or the sabot 24. Accordingly, the sabot 20 is a partial length sabot (compared to conventional sabots).

In the illustrated embodiment, the sabot 24 engages the projectile 22 at about the middle of the projectile 22 and longitudinally therefrom to the base 24 of the projectile. However, the sabot 24 may be sized and configured differently to engage the projectile 22 at different portions and along more or less of the projectile 22. Thus, the sabot 24 may be positioned at different locations along the projectile 22 and which may not extend to the base or extend beyond the base of the projectile 22 in some embodiments. For example, in various embodiments, the sabot 24 extends beyond the aft end of the projectile 22 to prevent an unintentional load path from being formed (e.g., prevent the projectile from contacting a push plate of the gun during firing or launch).

It should be noted that the projectile 22 may include other components, such as fins 114 that are shown in a retracted state in FIG. 1. When the sabot 20 (and optionally the sabot 24) disengages from the projectile 22 after being launched from the gun, the fins 114 extend outward from the projectile 22 and are subsequently controlled as needed during the flight of the projectile 22. Thus, as the projectile 22 with the sabot 20 (and optionally the sabot 24) is launched, the projectile 22 is propelled from within the sabot 20 and slides aft to separate from the projectile 22. Once the projectile 22 is fully expelled from the stepped sabot 20, the fins 114 extend outward, such as based on a biasing force that causes the extension of the fins 114. It should be noted that variations are contemplated. For example, in embodiments where the sabot 20 is engaged with or supported by the projectile 22 (and the sabot 24 is not provided), the fins 114 may be in an extended position prior to launch (e.g., within the bore of the launch platform) which may be a fixed extended position in some embodiments.

Thus, the sabot 20 may be configured to engage a separate sabot 24, each having complementary surfaces as described herein. The sabots 20 and 24 are configured to extend along and around at least a portion of the projectile 22 with the sabot 20 forward of the sabot 24. In general, the sabots 20 and 24 are also configured aerodynamically to disengage from the projectile 22 when launched.

Figure 8:
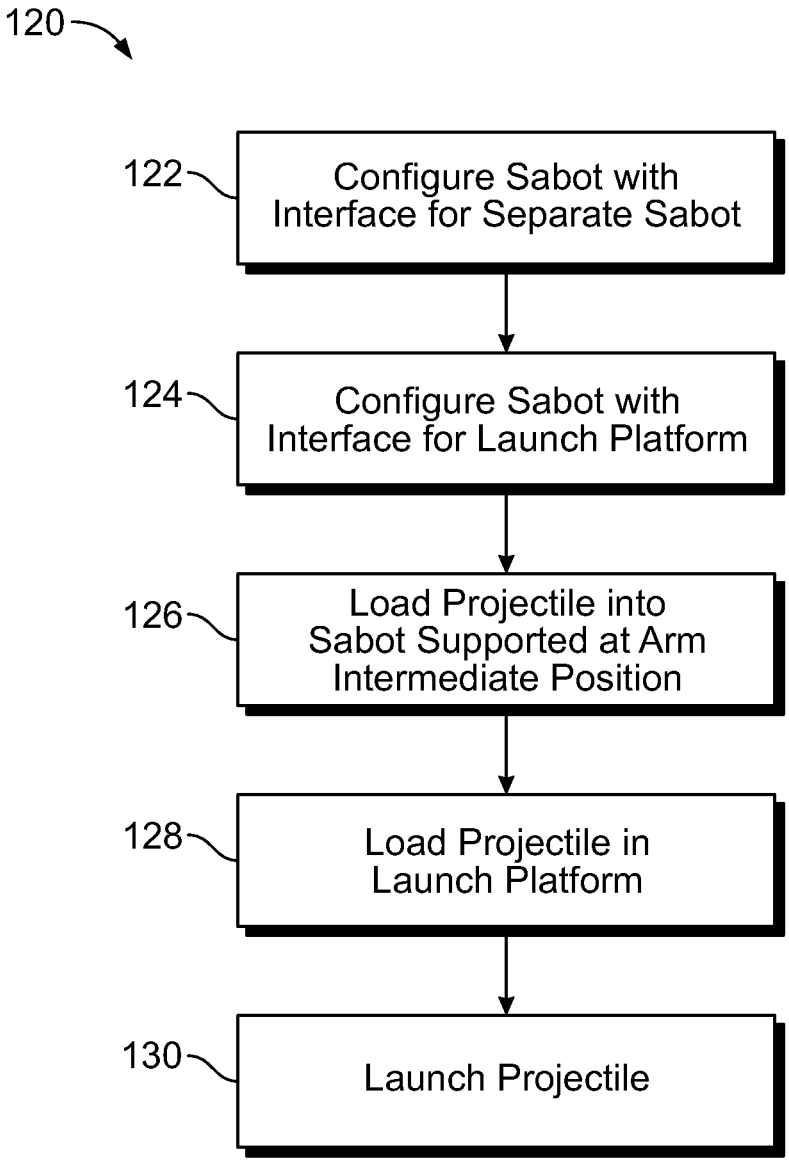
FIG. 8 is an illustration of operations performed by an embodiment to launch a projectile.

In various embodiments, a method 120 as shown in FIG. 8 may be provided for launching a projectile. In some embodiments, the method 120, for example, may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be reperformed in an iterative fashion.

The method 120 includes configuring a sabot with an interface for engaging a separate sabot at 122. For example, as described herein, the sabot 20 may include complementary and/or engagement portions fir engaging the sabot 24. The method 120 also includes configuring the sabot with an interface for engaging a launch platform at 124. For example, an outer profile of the walls of the sabot 124 may be sized and shaped to engage with the inner surface of a gun bore. As described herein, the profile may be changed based on the type of launch platform or application.

The method 120 further includes loading the projectile into the sabot at 126. As the projectile is loaded into the sabot, the sabot is supported at an intermediate position along the projectile. For example, as described herein, the sabot 20 may be supported in the intermediate position, between the forward and aft ends of the projectile 22 by the sabot 24 and/or the projectile 22.

The projectile with sabot(s) are then loaded in a launching device, such as a launch platform (e.g., cannon or gun) at 128 and launched (e.g., fired) at 130. For example, when thrust is applied to the aft surface of one of the sabots or the projectile, a force in the forward direction is applied to the projectile with the sabot coupled to the projectile. Once launched, the sabots separate from the projectile and optional fins may extend from the sabot as described herein.

Thus, the sabot of various embodiments may interface with one or more different separate sabot designs. For example, in some embodiments, the sabot is the supporting structure during the launch event, which enables the use of alternative sabot materials for the sabot as described herein. It should be noted that the sabot can also interface directly to the projectile body, such as for a base push projectile design. Various embodiments of the sabot may include materials sufficient to provide a mechanical interface with the projectile as described herein and the projectile includes receiving portions in the outer mold line (e.g., complementary portions). For example, the receiving portions are illustrated as groves 32 in FIG. 1, but may be other receiving features that interface with the sabot 24.

The sabot may be used in different applications including in a conventional gun (such as to increase the projective speed out of the bore), and are not limited to a railgun. Additionally, some embodiments improve avionics survivability with cost reductions, and/or reduce design constraints on the avionics package. In various embodiments, lower cost components may be used and/or improved gain of the selected sensors may be provided. Thus, various embodiments may provide a more efficient cost per shot and less power gun for certain performance characteristics or more may be allocated to the payload (lethal mechanism), thereby increasing range (higher ballistic coefficient due to additional mass that can be added to the projectile itself), and/or increasing the size of the lethal mechanism for a higher Pk given a shot.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from the scope thereof. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A sabot assembly comprising:

a first sabot configured to engage a projectile; and a second sabot, wherein the first sabot has at least a first portion that extends longitudinally outward and away from an end of the second sabot, and wherein the second sabot has at least a second portion that extends longitudinally outward and away from an opposite end of the first sabot, wherein the first sabot is configured to extend along a greater axial length of a cylindrical body of the projectile than the second sabot to support the second sabot in an intermediate position between a front end and an aft end of the projectile, the second sabot including:

a body formed from at least one section, the body configured to surround a portion of the projectile;

one or more engagement portions configured to interface the body with the first sabot such that the body is supported at an intermediate position of the projectile;

one or more surfaces configured to interface with an outer mold line of the projectile; and one or more surfaces configured to interface with an inner surface of a launch platform.

2. The sabot assembly of claim 1, wherein the one or more surfaces configured to interface with an outer mold line of the projectile comprise concave inner wall portions of the body configured to mate with an outer surface of the projectile.

3. The sabot assembly of claim 1, wherein the launch platform is a railgun and the one or more surfaces configured to interface with an inner surface of the launch platform are shaped to interface with an inner surface of the railgun.

4. The sabot assembly of claim 3, wherein the one or more surfaces configured to interface with an inner surface of the launch platform comprise concave outer wall portions of the body.

5. The sabot assembly of claim 1, wherein the launch platform is a non-railgun and the one or more surfaces configured to interface with an inner surface of the launch platform are shaped to interface with an inner surface of the non-railgun.

6. The sabot assembly of claim 5, wherein the one or more surfaces configured to interface with an inner surface of the launch platform comprise convex outer wall portions of the body.

7. The sabot assembly of claim 1, wherein the body is formed from a plurality of separate sections configured to compressingly engage one another.

8. The sabot assembly of claim 7, wherein the plurality of separate sections comprise complementary shoulders that engage each other.

9. The sabot assembly of claim 7, wherein the plurality of separate sections define a web-shaped body.

10. The sabot assembly of claim 7, wherein the plurality of separate sections comprise supports and a thickness of at least some of the supports being different than at least some other ones of the supports.

11. The sabot assembly of claim 1, wherein the body comprises a bore therethrough having a varying diameter and configured to receive a portion of the projectile therein.

12. The sabot assembly of claim 1, wherein the one or more engagement portions configured to interface the body with the first sabot are shaped to engage a scooped front end of the other sabot.

13. The sabot assembly of claim 1, wherein the intermediate position of the projectile is a region along the projectile such that when the body is engaged therewith a balloting of the projectile is reduced during launch.

14. A sabot assembly comprising:

an axial sabot configured to engage a projectile; and a secondary sabot, wherein the axial sabot has at least a first portion that extends longitudinally outward and away from an end of the secondary sabot, and wherein the secondary sabot has at least a second portion that extends longitudinally outward and away from an opposite end of the axial sabot, wherein the axial sabot extends along a greater axial length of a cylindrical body of the projectile than the secondary sabot to support the secondary sabot in an intermediate position between a front end and an aft end of the projectile, the secondary sabot including:

a body having an interface for engaging the axial sabot; and at least two complementary components defining an interface for an outer mold line of the projectile and an interface for a barrel of a launch platform, wherein the body comprises a moldable material and is configured to reduce balloting of the projectile during launch.

15. The sabot assembly of claim 14, wherein the launch platform is a railgun and the interface for the barrel of the launch platform comprises concavely shaped outer walls of the body to interface with an inner surface of the barrel of the railgun.

16. The sabot assembly of claim 14, wherein the launch platform is a non-railgun and the interface for the barrel of the launch platform comprises convexly shaped outer walls of the body to interface with an inner surface of the barrel of the non-railgun.

17. The sabot assembly of claim 14, wherein the body is formed from a plurality of separate sections configured to compressingly engage one another and define a web shaped body.

18. The sabot assembly of claim 17, wherein the plurality of separate sections comprise supports and a thickness of at least some of the supports being different than at least some other ones of the supports.

19. A projectile assembly comprising:

an axial sabot;

a cylindrical body having a plurality of grooves on an outer surface thereof, the plurality of grooves configured to engage the axial sabot; and a secondary sabot, wherein the axial sabot extends along a greater axial length of the cylindrical body than the secondary sabot to support the secondary sabot in an intermediate position between a front end and an aft end of the projectile assembly, the secondary sabot comprising a body formed from at least one section, the body configured to surround a portion of the cylindrical body, one or more engagement portions configured to interface the body with the axial sabot such that the body is supported at an intermediate position of the cylindrical body, one or more surfaces configured to interface with an outer mold line of the cylindrical body, and one or more surfaces configured to interface with an inner surface of a launch platform.

20. The projectile assembly of claim 19, wherein the axial sabot has at least a first portion that extends longitudinally outward and away from an end of the secondary sabot, and wherein the secondary sabot has at least a second portion that extends longitudinally outward and away from an opposite end of the axial sabot.

* * * * *